United States Patent [19]

Kuroki

[11] Patent Number: 4,976,915

[45] Date of Patent: Dec. 11, 1990

[54] METHOD FOR FORMING A POWDERED OR A GRANULAR MATERIAL

[75] Inventor: Takanori Kuroki, Munakata, Japan

[73] Assignee: Kuroki Kogyosho Co., Ltd., Fukuoka, Japan

[21] Appl. No.: 226,583

[22] Filed: Aug. 1, 1988

[51] Int. Cl.[5] ..... B22F 3/06

[52] U.S. Cl. ..... 419/8; 29/423; 264/56; 264/125; 419/23; 419/24; 419/26; 419/42; 419/43; 419/49; 419/69; 428/558

[58] Field of Search ..... 264/60, 56, 112, 124, 264/125; 425/78; 419/5, 8, 9, 10, 11, 24, 43, 49, 50, 61, 66, 68, 69, 23, 42, 26; 72/77, 78; 29/423, 599; 428/558

[56] References Cited

U.S. PATENT DOCUMENTS 3,205,289 9/1965 Carpenter ..... 264/320
4,126,451 11/1978 Nayar ..... 419/8
4,362,563 12/1982 Stadler ..... 419/5
4,584,170 4/1986 Aslund et al. ..... 419/5
4,640,816 2/1987 Atzmon et al. ..... 419/24

FOREIGN PATENT DOCUMENTS 1068227 1/1984 U.S.S.R. ..... 264/125

*Primary Examiner*—Mary Lynn Fertig
*Attorney, Agent, or Firm*—Jordan and Hamburg

[57] ABSTRACT

A method in which various kinds of powdered or granular materials such as metal, ceramic and the like are put into a metal cylindrical container which can be plastically-deformed, or in the space between a container and a core or a substrate, the surroundings are sealed so that the powdered or granular materials do not leak out, the container is locally pressed by a small roller, and the locally pressed treatment is provided to the whole container region. Therefore, the internal powdered or granular materials are pressurized to a uniform density without regard to selective parts, and the materials are formed to various shapes by means of the local pressing.

18 Claims, 5 Drawing Sheets

METHOD FOR FORMING A POWDERED OR A GRANULAR MATERIAL

BACKGROUND OF THE INVENTION

The present invention relates to a method for forming a powdered or a granular material into a shape prior to agglomerating the powdered or granular material by itself or to an outer and/or inner surface of a substrate using a container.

BACKGROUND OF THE INVENTION

As a method for obtaining a desired object made of a powdered or a granular material of various kinds of metals or ceramics, the powdered or granular material is formed to a desired shape, and then is agglomerated by a sintering or powder forging method. In these cases, corresponding to the material shape or sintering process employed, a container sealing the material is used. There are some methods including build-up welding, and also a method for sticking a wear-resistant, a heat-resistant or a corrosion-resistant material to an outer surface of a roll, in which a container made of a heat-resistant material such as a mild steel covers a roll at certain intervals, a powdered or a granular material made of a wear-resistant, a heat-resistant or a corrosion-resistant material is packed in a space between the container and roll, hot isostatic pressing under high temperature and high pressure is used to pack the powdered or granular material, and then the powdered or granular material is tightly stuck and sintered to the outer container surface. The method can be applied in the same manner when the substrate is a hollow body and a powdered or granular material is tightly adhered to an inner surface of a wall in the hollow of the substrate.

In the case of agglomerating a powdered or a granular material by itself, the material is packed into a container shaped to a desired shape and sealed. In this case, a gap in a top portion of the container cannot be avoided in practice, because the packed density of the material is smaller in the top portion.

When sticking a desired material to an outer surface of a substrate using hot isostatic pressing, the space between the substrate and the container is often narrow, it is difficult to pack a powdered or a granular material at a uniform density, and the obtained layer is often non-uniform.

Accordingly, in the conventional method, in which a container with a space wider than the required space between the substrate and the container is used, a powdered or a granular material is easily at uniform density, an excess part is set for shrinkage of the small packed density, and then the excess part is cut away. Therefore, this method wastes both the material itself and the time for cutting a sintered body layer having high strength.

Furthermore, even if the strength and other directional properties are enhanced using a fibrous material or a material mixed with a fibrous structure to impart directionality through the fibrous structure to the product after agglomerating, it is difficult to achieve in an ordinary manner packing of the powdered and granular material even if a fibrous structure is used.

SUMMARY OF THE INVENTION

It is an object of the present invention to provide a method, in which each problem in the conventional technique is solved, a desired shape body is easily obtained at the time of forming a powdered or granular material by itself, or forming the material as a sintered layer to an outer surface of a hollow inner wall surface of other members, and the density of the formed layers is entirely uniform.

It is another object of the present invention to provide a method, in which a powdered or granular material is made uniform in a desired direction and a directional property is given to the obtained object when part of the powdered or granular material contains a one-sided long shaped object such as a fibrous object.

The objects of the present invention are achieved by the following steps: a powdered or granular material comprising at least one of a metal, a ceramic and carbon isput in a metal cylindrical container, the container is sealed and is locally pressed by a pressing member from an outer surface of the container while rotating the container about a longitudinal axis of the container as a rotating center, and the local pressing member is progressively moved to deform the container, whereby the powdered or granular material will be formed to a shape fitting the deformation of the container under a state that packing density is uniform at almost every part. In one case, a core is put in the cylindrical container in advance, the powdered or granular material is put in a space between the container and core and is progressively locally pressed from the outer surface of the container, whereby a powdered or granular material having a desired shape is formed around the container. In another case, the metal cylindrical container is put in a hollow part of a substrate, the hollow part having an opening to the outer surface at a pipe or anywhere, as does the substrate, the powdered or granular material is put in around the cylindrical container and is progressively locally deformed from an inner surface of the cylindrical container while rotating the whole container, whereby a powdered or granular material is formed having a shape conforming to the hollow inner wall of the substrate.

DESCRIPTION OF THE PREFERRED EMBODIMENTS

The present invention will now be explained in detail. In the present invention, a powdered or a granular material is formed to a desired shape in advance of the time when the powdered or granular material is formed itself or agglomerated to an outer surface or an inner surface of another object. After forming a desired shape by a method of the present invention, the formed powdered or granular material is agglomerated in an ordinary manner such as sintering or powder forging. Therefore, all of the raw material which is agglomerated in an ordinary manner is able to be used as the raw material of the powdered or granular material in the present invention. Therefore, metal(contains alloy), ceramic, carbon or its composite, or a single object or mixtures of various kinds of ceramics, and glass are used for the raw material of powdered or granular material.

Figure 1:
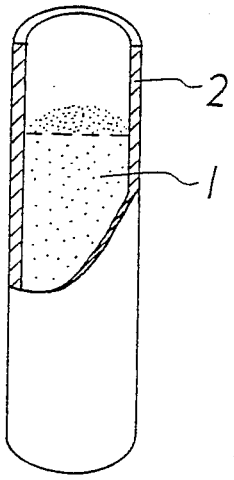
FIG. 1 shows the state in which only a powdered material is put in a container by a method of the present invention.
Figure 2:
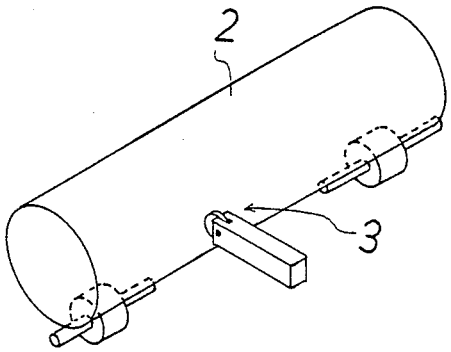
FIG. 2 shows a local pressing process.
Figure 3:
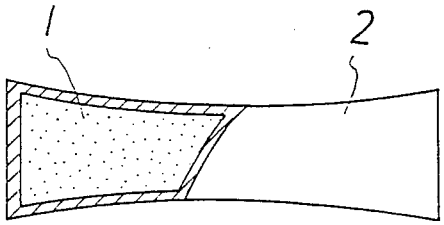
FIG. 3 shows the obtained product.

Various kinds of powdered or granular materials 1 are put into a metal(contains alloy) container 2 as shown in FIG. 1, the container is kept transverse and free to be rotated as shown in FIG. 2, the container 2 is locally pressed from an outer surface using a small roller 3 while rotating container 2, and the container 2 is deformed by changing the part to be pressed along a longitudinal direction as shown in FIG. 3. Various means such as pressing by a small roller, pushing by a spatula and locally hitting with a hammer are used as tools for locally pressing as shown in FIG. 2. The pressing tool is not limited to one, but multiple pressing tools can be arranged at appropriate positions and used at the same time. Also, local pressing is sometimes done by heating the whole container or only the part to be pressed.

Figure 4:
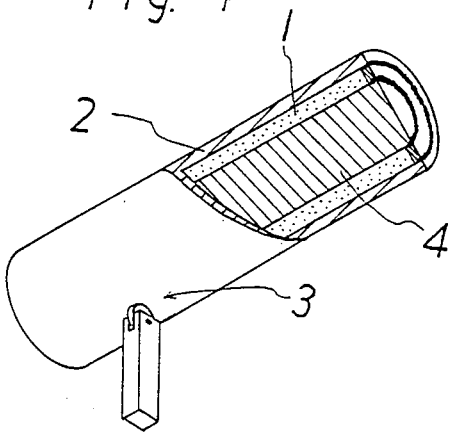
FIG. 4 shows the state in which a powdered material packed in a space between a core and the container is locally pressed.

Next, FIG. 4 shows the condition in which a core 4 is inserted into an inner part of the metal container 2, the edge parts are fixed by welding as a tentative stopper to a condition where an outer surface of core 4 and an inner wall of the container 2 are almost the same distance apart at any point, a powdered or granular material 1 is packed in the space between the outer surface of the core 4 and the inner wall of the container 2, an open part of the container 2 is sealed and the container is locally pressed by a small roller 3 in the same manner as shown in FIG. 2.

Figure 5:
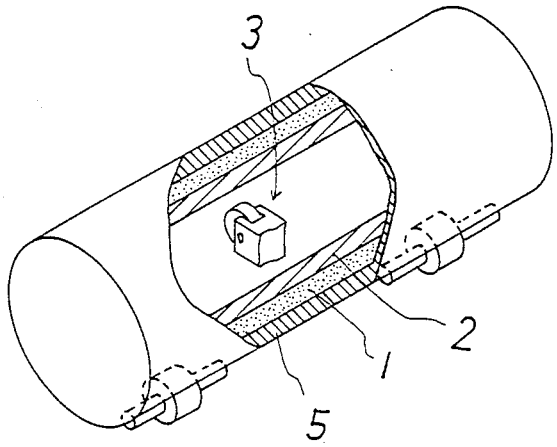
FIG. 5 shows the state in which the powdered material is stuck to the hollow inner wall of a substrate.
Figure 6:
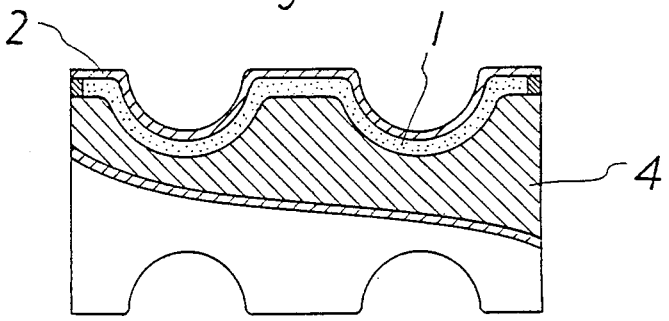
FIGS. 6–8 show views of the product of Examples 1–3 of the present invention.
Figure 7:
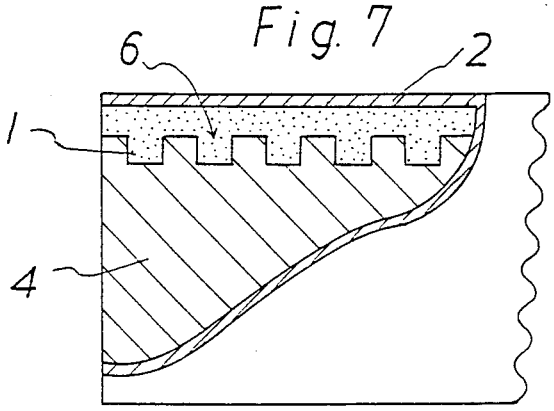
Figure 8:
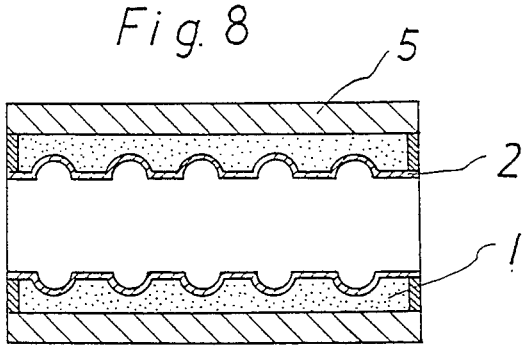

FIG. 5 shows the condition in which a metal cylindrical container 2 is inserted into a hollow substrate 5 to a condition where the space between the outer surface of container 2 and the hollow inner wall of the substrate 5 is almost the same distance at any point, the required parts of the container 2 are sealed to prevent the escape of granular material 1 and the container is locally pressed from an inner side of the container 2 by the small roller 3. By using the methods shown in FIG. 4 and FIG. 5, a powdered or granular material 1 is formed to a desired shape covered by the container 2 to an outer surface of the core 4 or an inner surface of the substrate 5. A product in which the deformation of different parts of the container 2 are each different as shown in FIG. 3 is obtained, powdered or granular material 1 is able to be arranged to an outer surface at almost uniform thickness even if the outside diameter of core 4 is greatly different at different parts as shown in FIG. 6, a product in which a groove 6 is provided to an outer surface of the core 2 as shown in FIG. 7 is able to be obtained, and powdered or granular material 1 is able to be formed to a different shape by local pressure by means of changing the deformation of the container 2 at different parts as shown in FIG. 8.

In the methods shown in FIG. 2, FIG. 4 and FIG. 5, an open part of the container 2 or the space between the container 2 and the core 4 or the substrate 5 is made wide enough at the first packing of powdered or granular material 1 by a method of the present invention. The container 2 is further reduced or extended in diameter by local pressing treatment after the packing of powdered or granular material 1, so that the first packing of powdered or granular material is very easily done because the packing is considerably loose. Even when finally forming powdered or granular material 1 to various kinds of shapes, a simple cylindrical shape is enough for the first shape of container 2. A local pressing means such as a small roller, etc. is used for tightening powdered or granular material 1 and forming to a desired shape in the method of the present invention. Therefore, there is no problem of a solution entering powdered or granular material 1 because container 2 breaks. The diameter and thickness of the formed powdered or granular material 1 can be changed at different points by means of local pressing because the first shape of container 2 is a simple shape and the packing method of powdered or granular material 1 is simple, as shown in FIG. 1.

Next, regarding the behavior of powdered or granular material 1 packed in the container 2 or the space between the container 2 and the core 4 or the substrate 5 in the method of the present invention, powdered or granular material 1 is not packed by means of feeding or forcing by pressure in the method of the present invention. Therefore, there is a cavity naturally arising in the powdered or granular material and the unavoidable cavity rises to an upper edge part of the packed powdered or granular material. Also, the powdered or granular material has fluidity of considerable range with rotation of the container 2, and non-uniform density at each part is solved at the termination step of forming by local pressing.

This phenomenon is further taken into account by keeping the volume of the first packing of powdered or granular material 1 at less than the volume of the container space for the first packing of powdered or granular material 1. Powdered or granular material 1 is kept in a fluid state, in which material 1 is moved towards the container periphery by centrifugal forces when container 2 is rotated, the density of powdered or granular material 1 becomes essentially uniform throughout if the container 2 continues to rotate for a certain time, powdered or granular material 1 is easily formed because material 1 is easily moved at the time of deformation of the container 2 by local pressing, and the density of the formed layer is almost uniform throughout. In the method of the present invention, the formed material is kept in a tightened state; therefore, the density of the formed material does not become non-uniform when handling the formed material later because powdered or granular material 1 is hardly moved. By using a part or the whole of a powdered or a granular material 1 comprising a fibrous or a cut wire shape, the powdered or granular material can be directed in the longitudinal direction of the container when the space is progressively reduced with rotation of container 2; therefore, the formed layer can be given a pronounced directionality.

Additionally, in the method of the present invention, transverse setting, vertical setting and oblique setting rotations can be properly selected for rotation of the container 2 during local pressing by considering the shape of the container 2. A transverse setting rotation is desirable because the change of the packing density of powdered or granular material 1 by gravity is alleviated when container 2 is considerably long in the longitudinal direction. A vertical setting rotation is influenced by gravity not so much when the container 2 is short or flattened. A vertical setting rotation is more desirable rather than a transverse setting rotation considering the ease of rotation. Furthermore, a branch pipe extending to the outer direction can be arranged to the container 2, in which case it is desirable to rotate by vertical setting and to use gravity with centrifugal force when it is necessary to pack powdered or granular material 1 into the branch pipe.

Accordingly, the shape of the container 2, the shape of the formed layer, and the ease of rotation have to be decided, and then a transverse setting, vertical setting or oblique setting have to be properly selected.

Examples of the method of the present invention will now be explained. However, the present invention is not limited to the following examples.

EXAMPLE 1

An austenitic stainless steel(sus316) powder which occupies 80% of the volume of the internal space was put into a cylindrical mild steel container(1 mm thickness, 150 mmϕ internal diameter × 500 mm), the internal space of the container was subjected to vacuum, the open part of the container was sealed and the container was transversely mounted on a rotary apparatus. A pushing pressure by a small roller was provided to an outer surface of the container during rotation, and then a local spinning was provided to the whole region of the container. The formed body was kept at 1150° C., under the condition of 100 $Kg/cm^2$, for 2 hours in a hot isostatic pressing apparatus and then was taken out, the container was cut away and a stainless steel sintered body was obtained.

EXAMPLE 2

An edge plate made of mild steel having a 130 mmϕ open part corresponding to the center of a container was set to an edge open part of a container comprising the same material, shape and size as in Example 1, a rodlike core made of S45C steel having an outer diameter just fitting the open part of the edge plate and a 495 mm length was prepared, the core was inserted into the container such that the outer edge surface was supported by the open part of the edge part and the core placed to the center of the container, the space between the outer edge surface and the container and the space between the open part of the edge plate and the core were sealed by welding, and a Co-based heat-resistant alloy powder having 80% of the volume of the space was packed from another edge open part of the container into the space between the container and the core. Next, an edge plate similar to the abovedescribed edge plate was welded to another edge open part of the container, and then the space of the container was drawn in a vacuum and then was sealed. The container was locally pressed with rotation in a transverse setting, and then was inserted into a hot isostatic pressing apparatus and was kept at 1150° C. for 1 hour and then was taken out, the container was cut away, and a product of a Co-based heat-resistant alloy sintered layer having a uniform thickness and uniform density stuck to the surface of the core was obtained.

EXAMPLE 3

A mild steel container(2 mm thickness, 120 mm outer diameter, 500 mm length) was inserted in a cylindrical substrate made of S45C steel(10 mm thickness, 150 mm inner diameter, 500 mm length), an austenitic stainless steel (SUS316) powder which occupies 80% of the volume of the space between the cylindrical substrate and the container was put into the space, both edges of the space were sealed, the internal space was drawn in a vacuum and was pushpressed by a small roller from an inner surface of the container with rotation at a transverse setting on a rotary apparatus, and local diameter-extending work was performed on the whole region of the container. The formed body was sintered in a hot isostatic pressing apparatus as in Example 1, only the inside of the container was cut away, and a product having a stainless steel sintered layer stuck to the inner surface of the substrate was obtained.

Additionally, other examples will now be explained in detail with reference to FIGS. 9–14.

Figure 9:
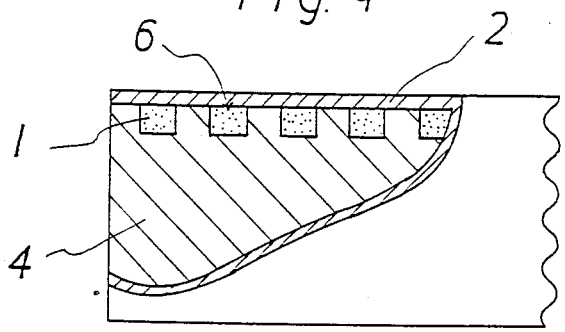
FIGS. 9–14 show views of other Examples of the present invention.
Figure 10:
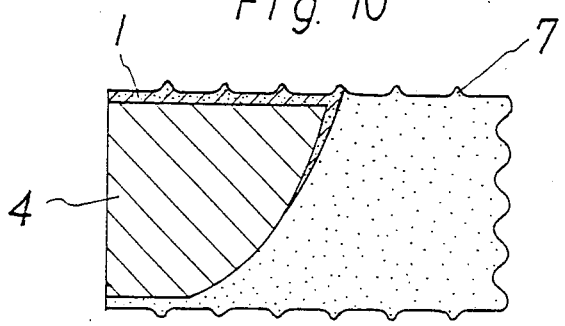
Figure 11:
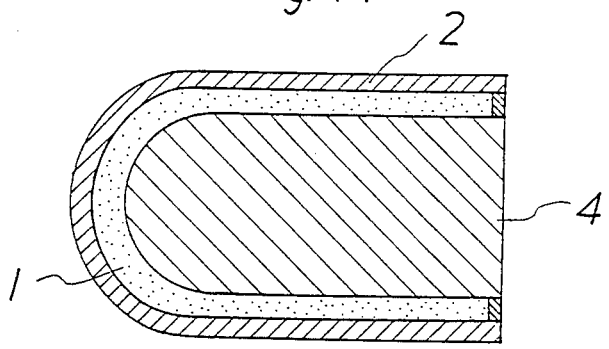
Figure 12:
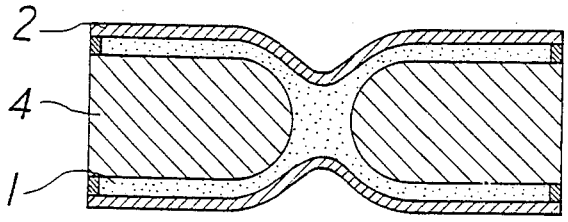
Figure 13:
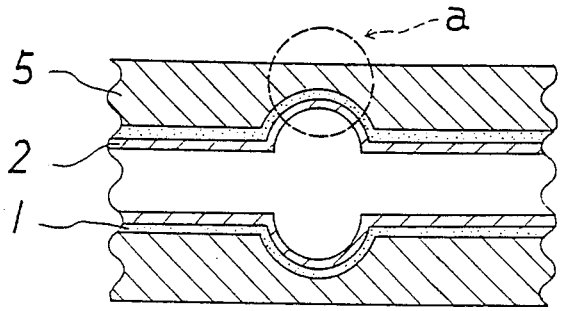
Figure 14:
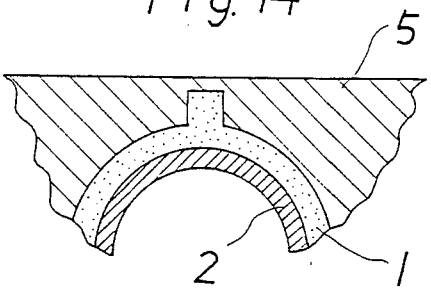

As shown in FIG. 9, the amount of powdered or granular material 1 and the deformation amount of container 2 are controlled for a core 4 having a groove 6 to an outer surface and powdered or granular material 1 is introduced only into the groove 6. The example is useful when a property which is different from a substrate 5 is desired to be imparted to only the part corresponding to the groove 6. FIG. 10 shows the state after removal of outer container 2, wherein a projecting bar 7 is given to an outer surface of formed material layer 1 after forming in a process of deforming the container 2. FIG. 11 shows an example, in which a powdered or a granular material 1 is also stuck to a round-shaped top edge surface as well as around a side surface. FIG. 12 shows the state when two products shown in FIG. 11 are formed simultaneously. This method is simple because a pipe-shaped container can be used. FIG. 13 shows an example, in which a cavity having a larger diameter than the other parts is placed centrally of the internal cavity of the substrate 5, and FIG. 14 shows an example, in which a concave projection is added to the section a shown in FIG. 13.

In the present invention, it is possible to extend the space through which a powdered or a granular material is easily packed compared with the conventional method and accompanying difficulties when a powdered or a granular material is put into a limited space. The present invention is further best suited for forming a powdered or a granular material layer which becomes a thin coating by limiting the space at a later step. The powdered or granular material is in its fluid state because a local pressing deformation is provided with rotation of the container, and it is also possible to avoid non-uniform packing density at each part and to easily select the diameter and the thickness of a powdered or a granular material after forming by means of the deformation. It is possible to obtain a container having a desired shape by settling the center of a core or substrate and giving a local pressure with rotation even if the container has a changed shape and bended shape, and the cost also becomes inexpensive. Since the powdered or granular material is sealed in the container at the time of local pressing and during the waiting until later heat treatment for agglomerating, there are no contaminations such as through oxidation. Furthermore, in the shapes shown in FIG. 6 and FIG. 13, two or three pieces of a divided-type container have to be used for covering the powdered or granular material from the first step.

The present invention solves problems such as an increased complexity of the process, deformation of the divided-type container during welding and contamination of the powdered or granular material, because the container is deformed after forming.

The deformation is not accomplished by a wet treatment using, for example, water; therefore, the apparatus is simple, the whole of the powdered or granular material is never contaminated and expensive material can be re-used.

In the present invention, a powdered or a granular material is packed in a container or the space between the container and a core or substrate, and then the powdered or granular material is formed to the desired shape and thickness. Therefore, it is possible to determine the exact amount of powdered or granular material by calculating the weight from the size of the desired sintered body. The relative density of the powdered or granular material changes in a wide range e.g. 50–60%, for every produced rod. Therefore, in the conventional method, various containers having various contents fitting every relative density have to be used, but in the present invention, it is possible to determine the exact amount of powdered or granular material for calculating the weight regardless of the relative density. The present invention has the advantage that the product size is exact and the size of the container used is almost constant.

Additionally, since the powdered or granular material is fluidly rotating for a long time in the container and also receives a force by local pressure, a part of an oxidating layer is broken, and an active metal surface is exposed even if the powdered or granular material has a strong oxidizing layer on an outer surface, e.g. Al, which can result in some difficulties in the later sintering, whereby the sinterability is improved. This is also applicable to the surface of the core and the substrate and not only the powdered or granular material. Therefore, the binding force of the powdered or granular material after agglomerating to the core or the substrate is enhanced. It is thus possible to form a polygonal-section-type product for local pressing using a polygonal lathe.

What is claimed is:

1. A method for forming a powdered or a granular material comprising:

(a) putting a volume of a powdered or granular material comprising at least one member selected from the group consisting of a metal, a ceramic and carbon in a metal cylindrical container, (b) sealing said container, (c) locally pressing an outer surface of said container with a local pressing member while rotating said container about a longitudinal axis of said container as a rotating center, and (d) progressively moving said local pressing member along said outer surface of said container to deform said container outer surface, whereby said powdered or said granular material is formed to a shape conforming to the deformed outer surface of said container.

2. A method according to claim 1, wherein said volume of said powdered or said granular material put in said container is less than an internal volume of said container.

3. A method according to claim 1, wherein at least a part of said powdered or said granular material has an elongated shape.

4. A method according to claim 2, wherein at least a part of said powdered or said granular material has an elongated shape.

5. A method for forming a powdered or a granular material comprising:

(a) loosely setting at least one cylindrical or rodlike core member in a metal cylindrical container to form at least one space between said core member and an inner surface of said container, (b) putting a volume of a powdered or granular material comprising at least one member selected from the group consisting of a metal, a ceramic and carbon in said at least one space between said core member and said inner surface of said container, (c) sealing said container, (d) locally pressing an outer surface of said container with a local pressing member while rotating said container about a longitudinal axis of said container as a rotating center, and (e) progressively moving said local pressing member along said outer surface of said container to deform said container outer surface, whereby said powdered or said granular material is formed to a shape conforming to the deformed outer surface of said container and an outer surface of said core member.

6. A method according to claim 5, wherein said volume of said powdered or said granular material put in said at least one space is less than a volume of said at least one space for said material.

7. A method according to claim 5, wherein at least a part of said powdered or said granular material has an elongated shape.

8. A method according to claim 6, wherein at least a part of said powdered or said granular material has an elongated shape.

9. A method for forming a powdered or a granular material comprising:

(a) loosely setting at least one metal cylindrical container in a hollow part of a substrate having at least one edge of a sectional round hollow part exposed to an outer part to form at least one space between said substrate and an outer surface of said container, (b) putting a volume of a powdered or granular material comprising at least one member selected from the group consisting of a metal, a ceramic and carbon in said at least one space between said outer space of said container and said substrate, (c) sealing said edges of said substrate exposed to said outer part, (d) locally pressing an inner surface of said container with a local pressing member while rotating said container about a longitudinal axis of said container as a rotating center, and (e) progressively moving said local pressing member along said inner surface of said container to deform said container inner surface, whereby said powdered or said granular material is formed to a shape conforming to the deformed inner surface of said container and an inner surface of said substrate.

10. A method according to claim 9, wherein said volume of said powdered or said granular material put in said at least one space is less than a volume of said at least one space for said material.

11. A method according to claim 9, wherein at least a part of said powdered or said granular material has an elongated shape.

12. A method according to claim 10, wherein at least a part of said powdered or said granular material has an elongated shape.

13. A method according to claim 3, wherein said material part having an elongated shape is a fiber.

14. A method according to claim 4, wherein said material part having an elongated shape is a fiber.

15. A method according to claim 7, wherein said material part having an elongated shape is a fiber.

16. A method according to claim 8, wherein said material part having an elongated shape is a fiber.

17. A method according to claim 11, wherein said material part having an elongated shape is a fiber.

18. A method according to claim 12, wherein said material part having an elongated shape is a fiber.

* * * * *